US006347488B1

(12) United States Patent
Koye

(10) Patent No.: US 6,347,488 B1
(45) Date of Patent: Feb. 19, 2002

(54) UTILITY POLE CROSS-ARM

(76) Inventor: Jeffrey T. Koye, 49 High Bridge Rd., New Egypt, NJ (US) 08533

( * ) Notice: Subject to any disclaimer, the term of this patent is extended or adjusted under 35 U.S.C. 154(b) by 0 days.

(21) Appl. No.: 09/579,226

(22) Filed: May 26, 2000

(51) Int. Cl.[7] ..... E04H 12/00

(52) U.S. Cl. ..... 52/40; 52/697; 52/720.1; 52/720; 52/736.2; 52/220.1; 174/45; 174/149; 174/146; 174/175

(58) Field of Search ..... 52/40, 697, 720, 52/720.1, 736.2, 220.1; 174/45, 149, 146, 175

(56) References Cited

U.S. PATENT DOCUMENTS

| | | | | |
|---|---|---|---|---|
| 1,021,831 A | * | 4/1912 | Ferringer | 52/40 |
| 2,890,793 A | | 1/1959 | Bailey | |
| 3,013,584 A | | 12/1961 | Reed et al. | 138/145 |
| 3,235,652 A | | 2/1966 | Lindsey | 174/45 |
| 3,531,578 A | | 9/1970 | Dey | 174/43 |
| 3,574,104 A | | 4/1971 | Medler | 5/28 |
| 4,262,047 A | | 4/1981 | Barnett et al. | 428/73 |
| 4,682,747 A | | 7/1987 | King, Jr. et al. | 174/45 |
| 4,728,749 A | * | 3/1988 | Knight | 52/40 |
| 4,867,399 A | | 9/1989 | Therond | 248/65 |
| 5,605,017 A | * | 2/1997 | Fingerson et al. | 52/40 |

* cited by examiner

*Primary Examiner*—Beth A. Stephan
*Assistant Examiner*—Chi Nguyen
(74) *Attorney, Agent, or Firm*—Paul A. Schwarz, Esq.; Duane, Morris & Heckscher, LLP

(57) ABSTRACT

A cross-arm for a utility pole, the cross-arm includes an elongated, hollow bar member molded from synthetic material, such as a sheet-molding compound of polyester glass-reinforced plastic. The elongated bar member has a first end, a second end opposite the first end, a plurality of through-holes for mounting the cross-arm to a utility pole with fasteners and for mounting electrical line support insulators. A groove extends from the first end to the second end of the elongated bar member, for receiving a wire or cable. A recess is provided in a wall of the elongated, hollow bar member which substantially conforms a section of the wall to the utility pole.

19 Claims, 3 Drawing Sheets

UTILITY POLE CROSS-ARM

FIELD OF THE INVENTION

This invention relates to utility poles, and more particularly, to a cross-arm for a utility pole, which is made from synthetic material.

BACKGROUND OF THE INVENTION

Power transmission lines are typically supported above the ground to provide isolation between them and the environment. One of the most common arrangements for supporting transmission lines utilizes a plurality of electrical insulators mounted on wooden cross-arms attached to vertical wooden poles. Because such cross-arms are fabricated from wood, they are subject to rotting and are relatively heavy. Consequently, when conventional wooden utility pole cross-arms need to be replaced, considerable manual effort is required not only in the removal of the deteriorated cross-arm but also in the installation of the replacement cross-arm.

Accordingly, a need exists for a utility pole cross-arm that is considerably less weighty and has a substantially indefinite life span.

SUMMARY OF THE INVENTION

A cross-arm for a utility pole, the cross-arm comprising an elongated bar member molded from synthetic material, the elongated bar member having a first end, a second end opposite the first end, and a plurality of through-holes for mounting the cross-arm to a utility pole with fasteners and for mounting electrical line support insulators.

One aspect of the invention involves a groove that extends from the first end to the second end of the elongated bar member, for receiving a wire or cable.

Another aspect of the invention involves a recess in a wall of the elongated bar member which substantially conforms a section of the wall to the utility pole.

Still another aspect of the invention involves first and second end-caps for enclosing the first and second ends of the elongated bar member.

BRIEF DESCRIPTION OF THE DRAWINGS

The advantages, nature, and various additional features of the invention will appear more fully upon consideration of the illustrative embodiments now to be described in detail in connection with accompanying drawings wherein.

Figure 1:
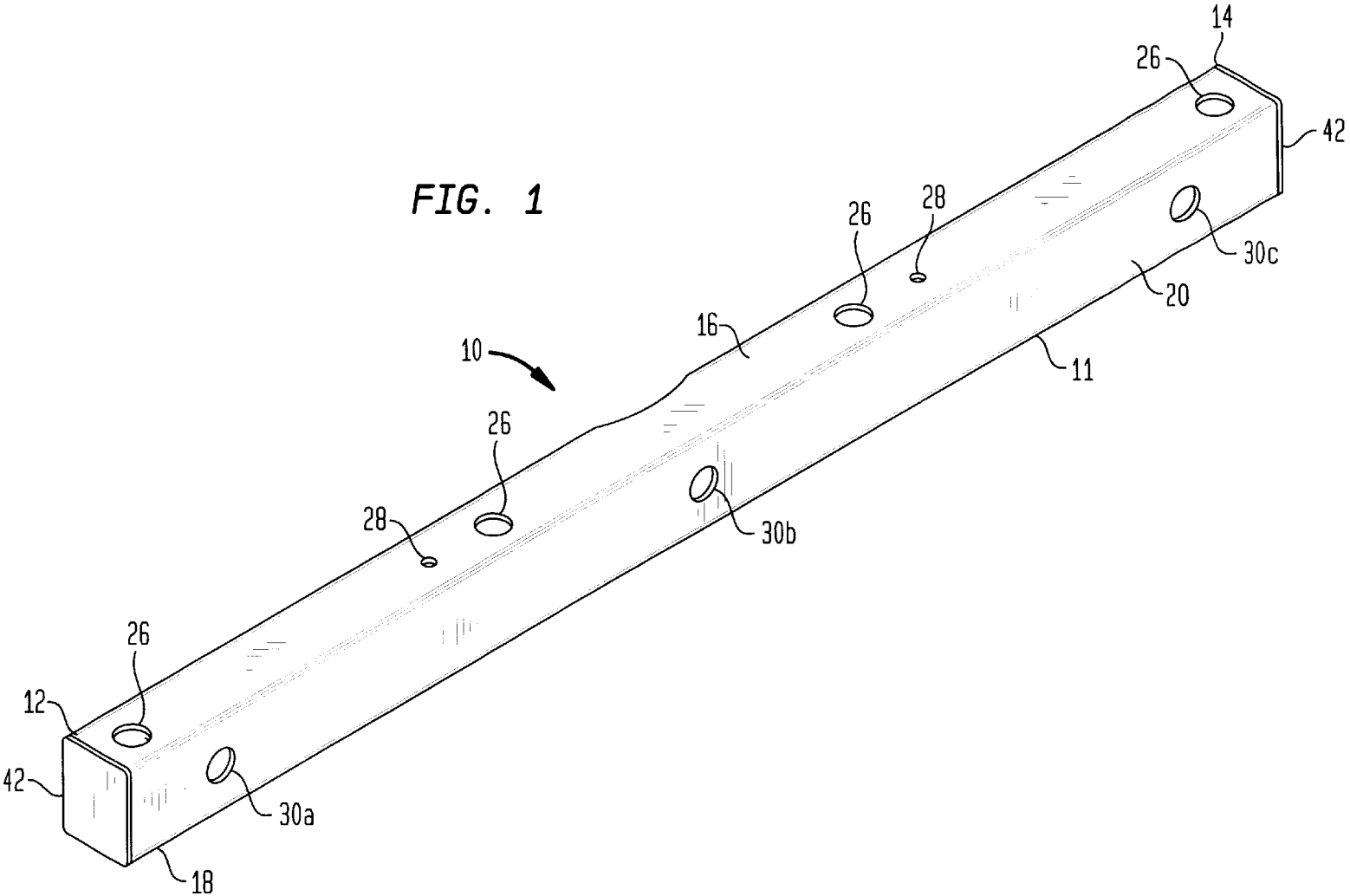
FIG. 1 is a perspective view of a cross-arm according to an illustrative embodiment of the invention.
Figure 2:
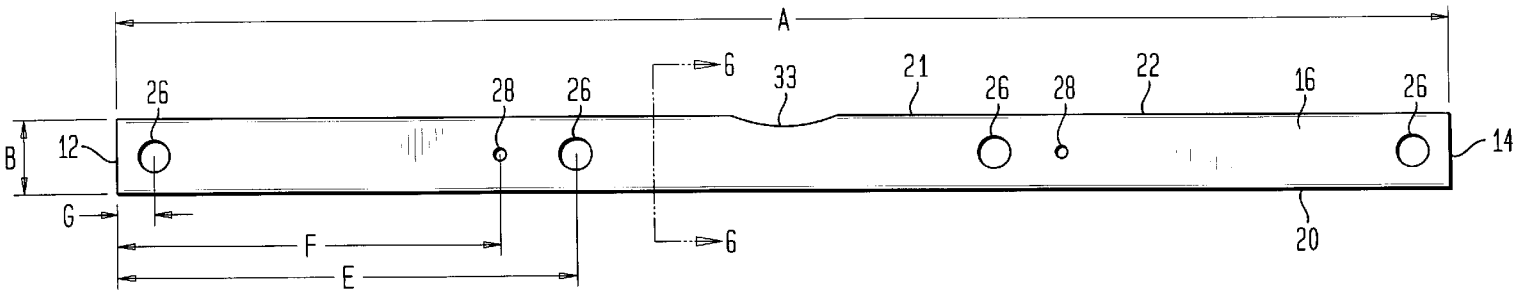
FIG. 2 is a top plan view of the cross arm.
Figure 3:
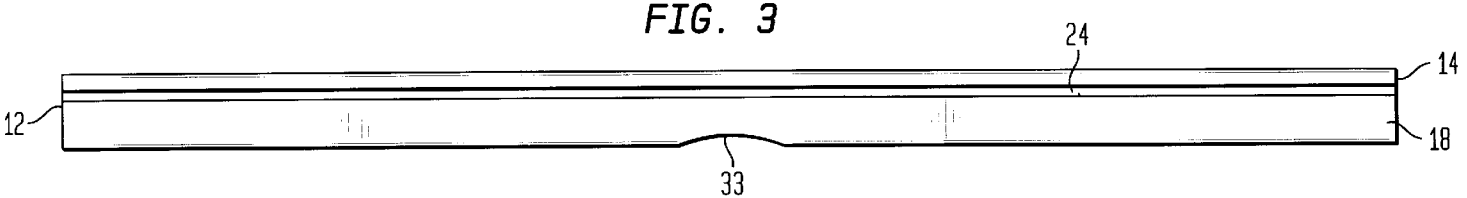
FIG. 3 is a bottom plan view of the cross arm.
Figure 4:
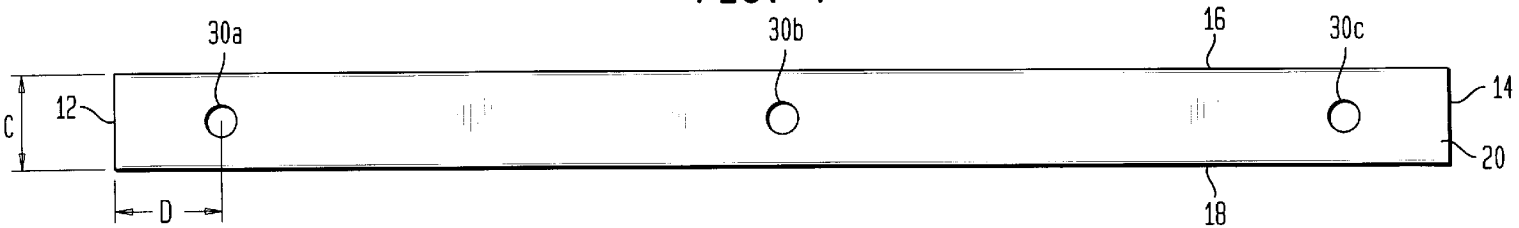
FIG. 4 is a elevational view of the cross arm.
Figure 5:
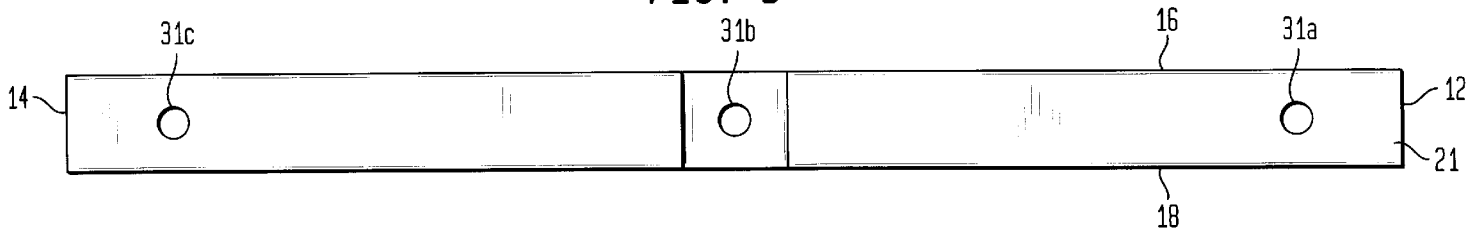
FIG. 5 is a rear elevational view of the cross arm.
Figure 6:
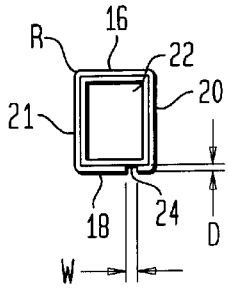
FIG. 6 is a sectional view of the cross arm through line 6—6 of FIG. 2.

It should be understood that the drawings are for purposes of illustrating the concepts of the invention and are not to scale.

DETAILED DESCRIPTION OF THE INVENTION

FIGS. 1–6 collectively depict a cross-arm 10 made according to an embodiment of the invention. The cross-arm 10 is typically used for supporting a plurality of power transmission lines and/or other cables and wires on a support structure, such as a vertical utility pole. The cross-arm 10 generally comprises an elongated, generally hollow bar member 11 molded from synthetic material. The bar member 11 preferably has a substantially rectangular cross-sectional shape, although other cross-sectional shapes are possible. The cross-arm 10 also has opposing first and second ends 12, 14, a top wall 16, a bottom wall 18, a front 20 wall and a rear wall 21 extending between the ends 12, 14. The top wall 16 of the cross-arm bar includes a plurality of through-holes 26, 28 for mounting conventional electrical line support insulators. The front wall 20 includes three through-holes 30*a*, 30*b*, 30*c*and the rear wall 21 includes three through-holes 31*a*, 31*b*, 31*c*. The through-holes 30*a*–*c* of the front wall 20 are axially aligned with corresponding through-holes 31*a*–*c* of the rear wall 21. The center through-holes 30*b*, 31*b*enable the cross-arm 10 to be horizontally mounted to a utility pole or other support pole, and the end through-holes 30*a*, 30*c*, 31*a*, 31*c*enable one or more cross-arms 10 to be bolted together as a single unit. The central section of the rear wall 21, which includes the central through-hole 31*b*, has an arcuate recess 33 which substantially conforms this section of the rear wall 21 to the curvature of the support pole so that the cross-arm 10 will not wobble when mounted thereto. The bottom wall 18 of the cross-arm 10 advantageously includes a continuous longitudinal groove 24 that extends from the first end 12 to the second end 14 of the cross-arm 10. The groove 24 is adapted for receiving a ground wire (typically a #4 CV) therein. The groove 24 allows the ground wire to be mounted substantially flush with the surface of the cross arm bottom wall 18 to facilitate installation of electrical line arresters and other pole top equipment. The ends 12, 14 of the cross-arm 10 are provided with plug-like end-caps 42 made from an electrically insulative material, such as plastic. The end-caps aid in preventing animals and insects from building nests in the interior 22 of the cross-arm 10. The unused through-holes 26, 28, 30*a*, 30*c*, 31*a*, 31*c*are also provided with plug-like caps (not shown) made from an electrically insulative material, such as plastic, which further aid in preventing animal and insect infestation.

The cross-arm 10 can be built to any suitable set of dimensions with representative embodiments of the cross-arm 10 being built to standard utility pole cross-arm dimensions. In such embodiments the walls 16, 18, 20 of the cross-arm 10 can have a thickness of about 0.65 inches and the comers of the cross-arm 10 can each have a radius R of about 0.375 inches. The groove 24 (FIG. 6) is typically about 0.25 inches in width (W) and about 0.188 inches in depth Table I below provides typical dimensions for cross-arms of the invention built to standard eight-foot and ten-foot lengths. The listed reference numerals and their corresponding dimensions are to be read with FIGS. 2 and 4.

TABLE I

| | | |
|---|---|---|
| A | 96 inches (8 foot) | 120 inches (10 foot) |
| B | 4 inches | 5 inches |
| C | 5 inches | 6 inches |
| D | 5.5 inches | 8 inches |
| E | 27.875 inches | 40 inches |
| F | 17.75 inches | 29.875 inches |
| G | 3.75 inches | 4 inches |
| H | 0.375 inches | 0.375 inches |

The synthetic material utilized for making the cross-arm comprises a sheet-molding compound of polyester glass-reinforced plastic. The cross-arm is typically manufactured using conventional thermoset compression molding techniques which generally involve a heat curing process that cures the sheet-molding compound. Suitable sheet-molding compounds of polyester glass-reinforced plastic are available from a variety of manufacturers. One preferred material is marketed by Jet Composites Incorporated in Ontario, Canada and marketed under part number JET-S-40-JTK. This material typically includes the following constituents, provided in approximate weight percentages: clay filler (ASP200 filler) 20.34%; styrene monomer 1.00%; electrical grade glass (1" E glass) 30.00%; polyester pigment dispersion 2.00%; hydrated aluminum 15.00%; fire retard additive (micothene FM510) 2.75%; resin modifier 8.79%; quinone 12%; zinc stearate 73%; vinyl ester resin (preferably DERAKANE 470-36 marketed by Dow Chemical Co.) 19.00%; and cumene hydroperoxide 0.27%. The properties of this material are provided in Table II below.

TABLE II

| PROPERTIES | ASTM METHOD | |
|---|---|---|
| Glass content | — | 30% |
| Units | — | Imperial |
| Impact Strength Izod notched | D-256 | 10.5 ft. lb./in. |
| Flexural Strength | D-790 | 22,000 PSI |
| Tensile Strength | D-638 | 10,500 PSI |
| Compressive Strength | D-695 | 21,000 PSI |
| Water Absorption 24 hrs. 23° C. | D-570 | 0.15 |
| Barcol Hardness | D-2583 | 50–60 |
| Heat Distortion Temp. @ 264 PSI | D-648 | 400° F. |
| Specific Gravity ± 0.05 | — | 1.81 |
| Shrinkage | | 0.0010 |
| Flammability (ABR) | D-365 | AEB < 0.20 in. ATB = 5 sec. |
| Ignition Temp. | UL Test Method | — |
| Oxygen Index | D-2863-70 | — |
| Arc Resistance, Sec. | D495 | — |
| Track Resistance | Incline Plane | 775 |
| Dielectric Strength S.T., Perp, VPM | D-149 | 350 |

Other synthetic materials which can be used for manufacturing the cross-arm of the invention include "POLYTRON", which is available from Industrial Dielectrics Incorporated in Nobelsville, Ind., and "PREMI-GLAS" #2000 Series available from Premix Incorporated in North Kingsville, Ohio, or Jet Composites Incorporated in Ontario, Canada.

Figure 7:
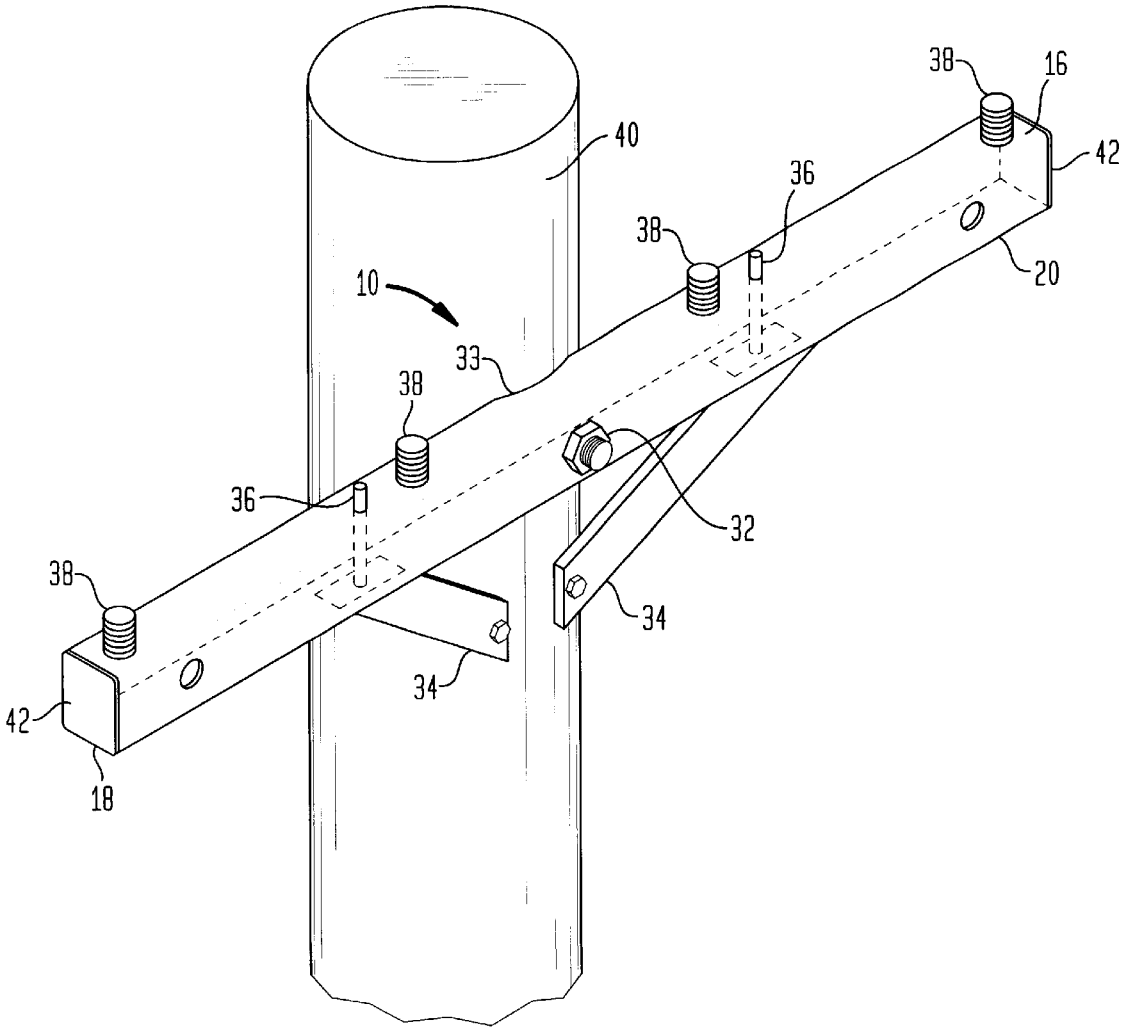
FIG. 7 is a perspective view showing the cross arm of the invention mounted to a support pole.

FIG. 7 shows a typical application of the cross-arm 10 of the invention. As shown, the cross-arm 10 is mounted adjacent the top end of a vertical supporting utility pole 40 such that the arcuate recess 33 in the rear wall 21 of the cross-arm 10 sits flush against the pole 40 without any significant wobbling. The centrally located through-holes 30*b*, 31*b* in the front and rear walls 20, 21 of the cross-arm receive a nut and bolt-type fastener 32 that secures the cross-arm 10 directly to the pole 40. A brace 34 supports the end portions of the cross-arm 10 to the pole 40 and thus, horizontally stabilizes the cross-arm 10. The brace 34 is coupled to the cross-arm via fasteners 36 that extend through the through-holes 28 in the top wall 16. Electrical line support insulators 38 are installed in through-holes 26 of the top wall 16 of the cross-arm 10.

While the foregoing invention has been described with reference to the above embodiments, additional modifications and changes can be made without departing from the spirit of the invention. Accordingly, all such modifications and changes are considered to be within the scope of the appended claims

What is claimed is:

1. A cross-arm for a utility pole, the cross-arm comprising an elongated bar member molded from synthetic material, the elongated bar member having a first end, a second end opposite the first end, a plurality of through-holes for mounting the cross-arm to a utility pole and for mounting electrical line support insulators, and a groove formed in a planar wall of the elongated member, the groove extending from the first end to the second end of the elongated bar member, the groove for receiving a wire or cable.

2. The cross-arm according to claim 1, wherein the synthetic material comprises a sheet-molding compound of polyester glass-reinforced plastic.

3. The cross-arm according to claim 1, wherein the elongated bar member is generally hollow.

4. The cross-arm according to claim 1, further comprising first and second end-caps for enclosing the first and second ends of the elongated bar member.

5. The cross-arm according to claim 4, wherein the end-caps are made from an electrically insulative material.

6. The cross-arm according to claim 1, further comprising hole caps for enclosing the through holes of the elongated member that are not used in mounting the cross-arm to a utility pole.

7. The cross-arm according to claim 6, wherein the hole caps are made from an electrically insulative material.

8. A cross-arm for a utility pole, the cross-arm comprising an elongated bar member molded from synthetic material, the elongated bar member having a first end, a second end opposite the first end, a plurality of through-holes for mounting the cross-arm to a utility pole and for mounting electrical line support insulators, and a recess in a wall thereof which substantially conforms a section of the wall to the utility pole.

9. The cross-arm according to claim 8, wherein the synthetic material comprises a sheet-molding compound of polyester glass-reinforced plastic.

10. The cross-arm according to claim 8, wherein the elongated bar member is generally hollow.

11. The cross-arm according to claim 8, further comprising first and second end-caps for enclosing the first and second ends of the elongated bar member and hole caps for enclosing the through holes in the elongated bar member that are not used in mounting the cross-arm to a utility pole.

12. The cross-arm according to claim 11, wherein the end-caps and the hole caps are made from an electrically insulative material.

13. The cross-arm according to claim 8, wherein the elongated bar has a groove that extends from the first end to the second end of the elongated bar member, the groove for receiving a wire or cable.

14. A utility pole comprising:

a vertical support pole;

a cross-arm including an elongated bar member molded from synthetic material, the elongated bar member having a first end, a second end opposite the first end, a plurality of through-holes for mounting the cross-arm to the support pole and for mounting electrical line support insulators, and a recess in a wall thereof; and fasteners for mounting the cross-arm adjacent to a top end of the support pole;

wherein the recess substantially conforms a section of the wall to the support pole.

15. The utility pole according to claim 14, wherein the synthetic material comprises a sheet-molding compound of polyester glass-reinforced plastic.

16. The utility pole according to claim 14, wherein the elongated bar member is generally hollow.

17. The utility pole according to claim 14, further comprising first and second end-caps for enclosing the first and second ends of the elongated bar member and hole caps for enclosing the through holes in the elongated bar member that are not used in mounting the cross-arm to the utility pole.

18. The utility pole according to claim 17, wherein the end-caps and hole caps are made from an electrically insulative material.

19. The utility pole according to claim 14, wherein the elongated bar has a groove that extends from the first end to the second end of the elongated bar member, the groove for receiving a wire or cable.

* * * * *

UNITED STATES PATENT AND TRADEMARK OFFICE

CERTIFICATE OF CORRECTION

PATENT NO. : 6,347,488 B1
DATED : February 19, 2002
INVENTOR(S) : Koye

It is certified that error appears in the above-identified patent and that said Letters Patent is hereby corrected as shown below:

Title page,
Following item [22], insert:
-- Related U.S. Application Data
[60] Provisional application No. 60/141,477 filed on Jun. 29, 1999. --

Signed and Sealed this

Fifteenth Day of October, 2002

*Attest:*

*Attesting Officer*

JAMES E. ROGAN
*Director of the United States Patent and Trademark Office*